US007722741B2

(12) United States Patent
Gronych et al.

(10) Patent No.: US 7,722,741 B2
(45) Date of Patent: May 25, 2010

(54) TRANSFER BELT

(75) Inventors: Daniel Gronych, Heidenheim (DE); Robert Koplin, Steinheim (DE); Klaus Hermann, Giengen (DE); Georg Kleiser, Heubach (DE); Arved H. Westerkamp, Dettingen/Ems (DE)

(73) Assignee: Voith Patent GmbH, Heidenheim (DE)

( * ) Notice: Subject to any disclaimer, the term of this patent is extended or adjusted under 35 U.S.C. 154(b) by 690 days.

(21) Appl. No.: 11/506,303

(22) Filed: Aug. 18, 2006

(65) Prior Publication Data

US 2007/0042851 A1 Feb. 22, 2007

(30) Foreign Application Priority Data

Aug. 19, 2005 (DE) ..... 10 2005 039 301

(51) Int. Cl.
*D21F 2/00* (2006.01)
*D21F 3/04* (2006.01)

(52) U.S. Cl. ..... 162/306; 162/358.2; 162/358.4; 162/901

(58) Field of Classification Search ..... 162/116, 162/348, 358.1, 358.2, 361, 900–904, 204–207, 162/358.4, 359.1, 360.3, 362; 428/163, 167, 428/131, 134, 137, 138, 156, 158–160, 172
See application file for complete search history.

(56) References Cited

U.S. PATENT DOCUMENTS

| | | | | |
|---|---|---|---|---|
| 4,206,258 | A * | 6/1980 | Balcar | 428/131 |
| 4,482,430 | A * | 11/1984 | Majaniemi | 162/358.4 |
| 4,842,905 | A * | 6/1989 | Stech | 428/33 |
| 5,240,563 | A | 8/1993 | Karvinen et al. | |
| 5,298,124 | A * | 3/1994 | Eklund et al. | 162/306 |
| 5,302,251 | A * | 4/1994 | Schiel et al. | 162/358.4 |
| 6,726,809 | B2 * | 4/2004 | Joyce et al. | 162/358.1 |
| 7,166,196 | B1 * | 1/2007 | Kramer et al. | 162/358.4 |

FOREIGN PATENT DOCUMENTS

| | | |
|---|---|---|
| DE | 11555972 | 10/1963 |
| EP | 1496152 | 1/2005 |

* cited by examiner

*Primary Examiner*—Eric Hug
(74) *Attorney, Agent, or Firm*—Taylor & Aust, P.C.

(57) ABSTRACT

This invention relates to a machine for the production of a paper web, paperboard web or tissue web, having a roller with a circumferential surface and having an endless belt, in particular a transfer belt, which is wrapped around the circumferential surface of the roller in sections and has a bottom side which in the wrap zone can be brought into contact with the circumferential surface, as the result of which the endless belt and/or the roller provide a storage capacity suitable for accommodating at least in part the fluid which gets into the wrap zone between the bottom side and the circumferential surface.

17 Claims, 3 Drawing Sheets

TRANSFER BELT

BACKGROUND OF THE INVENTION

1. Field of the Invention

This invention relates to an endless belt, in particular a transfer belt, for a machine for the production of a material web, in particular a paper web, paperboard web or tissue web. Also, the invention relates to a machine for the production of a material web, in particular a paper web, paperboard web or tissue web. Furthermore, the invention relates to a method for converting an existing machine for the production of a material web, in particular a paper machine, paperboard machine or tissue machine.

2. Description of the Related Art

Paper machines, paperboard machines or tissue machines can have central roller presses. In central roller presses known from the prior art, having one roller and several opposing rollers assigned to said roller such that each opposing roller forms a press nip with the roller, the wet fibrous web is drawn off the smooth roller (central roller) by an open draw. During this process, considerable draw-off forces are exerted on the fibrous web.

To reduce the draw-off forces it is proposed in the prior art to use a transfer belt wrapped around the central roller, with which the fibrous web is guided through the press nip and from which the fibrous web can be taken off by means of a suction take-off roller.

If moisture gets into the wrap zone between the central roller and the transfer belt, slip will occur between the powered central roller and the co-driven transfer belt, leading to aquaplaning. As a result, the drive power of the central roller cannot be transmitted sufficiently to the transfer belt, resulting potentially in web breaks or in wandering of the transfer belt and hence damage to the machine.

SUMMARY OF THE INVENTION

The object of the present invention is to propose an endless belt, in particular a transfer belt for a machine for the production of a material web, in particular for a paper machine, paperboard machine or tissue machine, whose use can eliminate or at least reduce the problems described above. Also, the object of the current invention is to propose a paper machine, paperboard machine or tissue machine improved in this way. Another object of the invention to propose a method for converting a known paper machine, paperboard machine or tissue machine into a paper machine, paperboard machine or tissue machine according to the invention.

In one aspect, f the invention is accomplished by an endless belt in particular a transfer belt for a machine for the production of a material web, in particular a paper web, paperboard web or tissue web, having a top side and an arranged opposite thereto, a bottom side such that when the endless belt is used as intended the top side can be brought into contact with the material web and the bottom side with the machine, the endless belt having a storage capacity for accommodating fluid acting on the bottom side.

In another aspect, the invention is accomplished by a machine for the production of a material web, paper web, paperboard web or tissue web, having a roller with a circumferential surface and having an endless belt, in particular a transfer belt wrapped around the circumferential surface of the roller in sections, with a bottom side which in the wrap zone can be brought into contact with the circumferential surface wherein at least one of the endless belt and the roller provide a storage capacity suitable for accommodating at least in part the fluid which gets into the wrap zone between the bottom side and the circumferential side.

In still another aspect, the invention is accomplished by a method for the production of a material web, in particular a paper web, paperboard or tissue web, in a machine comprising a press section with a roller, having a smooth circumferential surface, and two opposing rollers, each forming a press nip with the roller, whereby the roller is enwrapped by an endless belt which is guided through the two press nips and has a smooth bottom side that can be brought into contact with the circumferential surface, the method including the steps of replacing the roller having a smooth circumferential surface by a roller with a circumferential surface having a surface structure and replacing the endless belt having a smooth bottom side by an endless belt with a bottom side having a surface structure.

The known endless belt, in particular a transfer belt, has a top side and, arranged opposite thereto, a bottom side such that when the endless belt is used as intended the top side can be brought into contact with the material web, in particular with the paper web, paperboard web or tissue web, and the bottom side with the machine.

In the case of the endless belt of the invention, provision is made in addition for the endless belt to have a storage capacity for accommodating fluid which acts on the bottom side.

By the solution according to the invention, the fluid acting on the bottom side of the endless belt is accommodated at least in part in the endless belt. As a result, the fluid can be led away from the contact region between the circumferential surface of a roller and the bottom side of the endless belt. Therefore, there can be no build-up or only a conditional build-up of the fluid acting on the bottom side of the endless belt, e.g. water and/or air, into a fluid layer between the circumferential surface of the roller and the bottom side of the endless belt. As a result, the risk of aquaplaning between the endless belt and the roller casing, in particular in the press nip, is eliminated or at least greatly reduced.

According to an embodiment of the invention the storage capacity is provided at least in part by an at least partly porous structure of the endless belt. The porous structure can comprise, for example, a fleece and/or a fabric and/or a foamed structure, which extends at least in the region of the bottom side of the endless belt.

When a porous structure is exposed for a relatively long time to alternating compressive loads in the press nip, said structure will become increasingly compacted, as the result of which its fluid storage capacity is progressively reduced. To circumvent this problem, a particularly preferred further aspect of the invention provides for the storage capacity to be provided at least in part by the surface structure of the bottom side.

As the fluid storage capacity of the endless belt according to the invention is limited, a preferred embodiment of the invention provides for the surface structure to be constructed such that fluid passing through a press nip can be led away from the press nip. As the result, the risk of aquaplaning on the bottom side can be reduced further, in particular upon passing through a press nip and under the action of a large amount of fluid. In this case the surface structure can form a regular or an irregular pattern.

Here the surface structure is constructed preferably such that the storage capacity is essentially maintained during compressive loading in a press nip.

Furthermore it is conceivable for the endless belt to have a storage capacity which changes transversely with respect to the running direction. It is thus possible to compensate, for example, drag effects in the edge region of the endless belt. In this connection it is conceivable, for example, for the surface structure to form a regular pattern in some sections and an irregular pattern in some sections on the bottom side.

According to a concrete aspect of the previously mentioned embodiment the surface structure has a groove arrangement. A good storage effect and a good water discharge capability are provided by a groove arrangement in the bottom side.

The effect of the groove arrangement is particularly effective when the arrangement extends at least in sections longitudinally with respect to the running direction of the endless belt. The best results are obtained when the groove arrangement extends essentially longitudinally with respect to the running direction of the endless belt.

Tests have revealed that sufficient stability coupled with good fluid storage capacity and good fluid discharge capability is provided when the ratio of bar width to groove width is between 0.5 and 10.

In this case the grooves have a width of preferably between 0.2 and 10 mm, preferably between 1 and 5 mm, whereby the depth of the grooves amounts advantageously to less than 50% of the overall thickness of the endless belt.

An irregular surface structure can be provided in that, for example, the distance and/or the cross-sectional area and/or the shape of at least two adjacent grooves are different.

Tests have shown that sufficient fluid storage capacity for many applications, in particular with prior wiping of the endless belt, is provided when the surface structure of the bottom side has a roughness Ra from 3 to 40 μm. In this case the surface structure can be formed solely by the roughness, or the roughness is a part of the surface structure. The previously described roughness can be obtained by slightly grinding the bottom side or by using a suitably grainy material to manufacture the bottom side.

The bottom side is formed preferably by a permeable or impermeable polymer layer, in which case the surface structure is created during production of the polymer layer and/or after production of the polymer layer.

For example, the surface structure can be created during production of the polymer layer by casting or molding. Also, the surface structure can be created after production of the polymer layer by mechanical and/or thermal and/or chemical processing of the polymer layer.

Tests have shown that the aquaplaning effect, in particular when using the endless belt in a press arrangement, can be particularly reduced when the storage capacity is between 5 and 1000 milliliters per $m^2$ area of the bottom side, preferably between 50 and 500 milliliters per $m^2$ area of the bottom side.

Also proposed in accordance with the invention is a machine for the production of a material web, in particular a paper web, paperboard web or tissue web, having a roller with a circumferential surface and having an endless belt, in particular a transfer belt, which is wrapped around the circumferential surface of the roller in sections. The endless belt has a bottom side which in the wrap zone can be brought into contact with the circumferential surface, as the result of which the endless belt and/or the roller provide a storage capacity suitable for accommodating at least in part the fluid which gets into the wrap zone between the bottom side and the circumferential surface.

Thanks to the machine of the invention, the possible build-up of a fluid film in the contact region between the bottom side of the endless belt and the circumferential surface of the roller is prevented. As the result, the risk of aquaplaning between the endless belt and the roller can be effectively minimized if not completely eliminated.

To create sufficient storage capacity it is conceivable for the bottom side to be smooth and for the circumferential surface to have a surface structure for forming the storage capacity. Also, it is conceivable for the bottom side to have a surface structure for forming the storage capacity and for the circumferential surface to be smooth. Furthermore, provision can also be made for both the bottom side and the circumferential surface to have a surface structure for forming the storage capacity.

The surface structure of the circumferential surface comprises, preferably alone or in combination, a groove arrangement and/or a roughness of the circumferential surface and/or a regular or irregular structure.

Such a structure can be obtained by embossing for example.

Various materials alone or in combination, e.g. metal, plastic or rubber, are conceivable for forming the circumferential surface of the roller. If plastic is used, then it can be a thermoplastic or a duroplastic.

In order to provide not only a fluid storage capacity but also the capability to discharge fluid from the contact region between the bottom side of the endless belt and the circumferential surface of the roller, a preferred embodiment of the invention provides for the groove arrangement to extend essentially in the circumferential direction of the circumferential surface.

Tests have shown that the aquaplaning effect, in particular when using the roller in a press arrangement, can be particularly reduced when the storage capacity of the circumferential surface is a maximum 2000 milliliters per m2 area of the circumferential surface, preferably between 500 and 1500 milliliters per m2 area of the circumferential surface.

Also, tests have revealed that sufficient stability coupled with good fluid storage capacity and good fluid discharge capability can be provided when the ratio of bar width to groove width of the groove arrangement is between 0.5 and 10.

The grooves of the circumferential surface have a width of preferably between 0.2 and 10 mm, preferably between 1 and 5 mm. The ratio of groove depth to groove width is preferably between 10 and 0.2.

On the machine according to the invention the roller and an opposing roller preferably form a press nip such that the endless belt and a fibrous web are guided through the press nip and the endless belt is brought into contact with the roller while being guided through the press nip.

Needless to say, the roller can also be a shoe press roller with a rotating casing. In this case the claim should be understood to mean that the endless belt is brought into contact with the rotating casing of the shoe press roller while being guided through the press nip.

According to one embodiment of the invention, at least two opposing rollers are assigned to the roller, whereby the opposing rollers each form a press nip with the roller such that the endless belt and a fibrous web are guided through both press nips and the endless belt is brought into contact with the roller while being guided through each of the press nips. Such a press arrangement is called a central roller press. Here the previously mentioned roller forms the central roller.

The bottom side of the endless belt is preferably wiped and/or cleaned outside the wrap zone. A notable proportion of the fluid (water and/or air) which is carried along on the bottom side of the endless belt can be removed by the wiping. It is thus possible to effectively reduce the risk of aquaplaning with a surface structure of the bottom side which is formed only by roughness. As contaminants often form points of adhesion for fluid, thus resulting in more fluid being carried along on a contaminated bottom side, the risk of aquaplaning can be reduced in addition by cleaning the bottom side.

In order to increase the service life of the endless belt it makes sense for at least one doctor blade assigned to the bottom side to be a soft doctor blade, meaning a plastic doctor blade, which is not reinforced with fiber, in particular not with glass and/or carbon fiber. Concrete reference is made in this connection to a non-fiber-reinforced PE doctor blade for example, with a thickness of 6 mm for example. Such a doctor blade is marketed under the name Clouth AS for example.

Good wiping results are obtained, for example, when at least one doctor blade assigned to the bottom side is a doctor blade with which air can be blown out from the doctor blade tip. Such a doctor blade is also referred to as an air jet doctor blade.

Gentle treatment and hence an increase in the service life of the endless belt coupled with a very good wiping effect are obtained when at least one doctor blade assigned to the bottom side has an angle of incidence relative to the bottom side of less than 25°, in particular between 5° and 15°.

In addition or alternatively to conditioning the bottom side of the endless belt provision can be made for the circumferential surface of the roller outside the wrap zone to be assigned at least one doctor blade for wiping off fluid and/or at least one spray tube for its cleaning. The advantages previously described in connection with conditioning the bottom side apply similarly to this aspect of the invention.

In particular fiber-reinforced plastic blades are suitable for wiping the roller. Such doctor blades are marketed under the name Clouth C2 or C100 for example.

Disclosed in addition is a method for converting a machine for the production of a material web, in particular a paper web, paperboard web or tissue web. In this case the machine to be converted has a press section with a roller featuring a smooth circumferential surface, and two opposing rollers each forming a press nip with the roller. Here the roller is enwrapped by an endless belt which is guided through the two press nips and has a smooth bottom side that can be brought into contact with the circumferential surface.

In this case the method of the invention includes at least one of the following steps:

replacement of the roller with a smooth circumferential surface by a roller with a circumferential surface having a surface structure, replacement of the endless belt with a smooth bottom side by an endless belt with a bottom side having a surface structure.

Using the method of the invention it is possible to convert an existing machine with a central roller press into a machine according to the invention.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
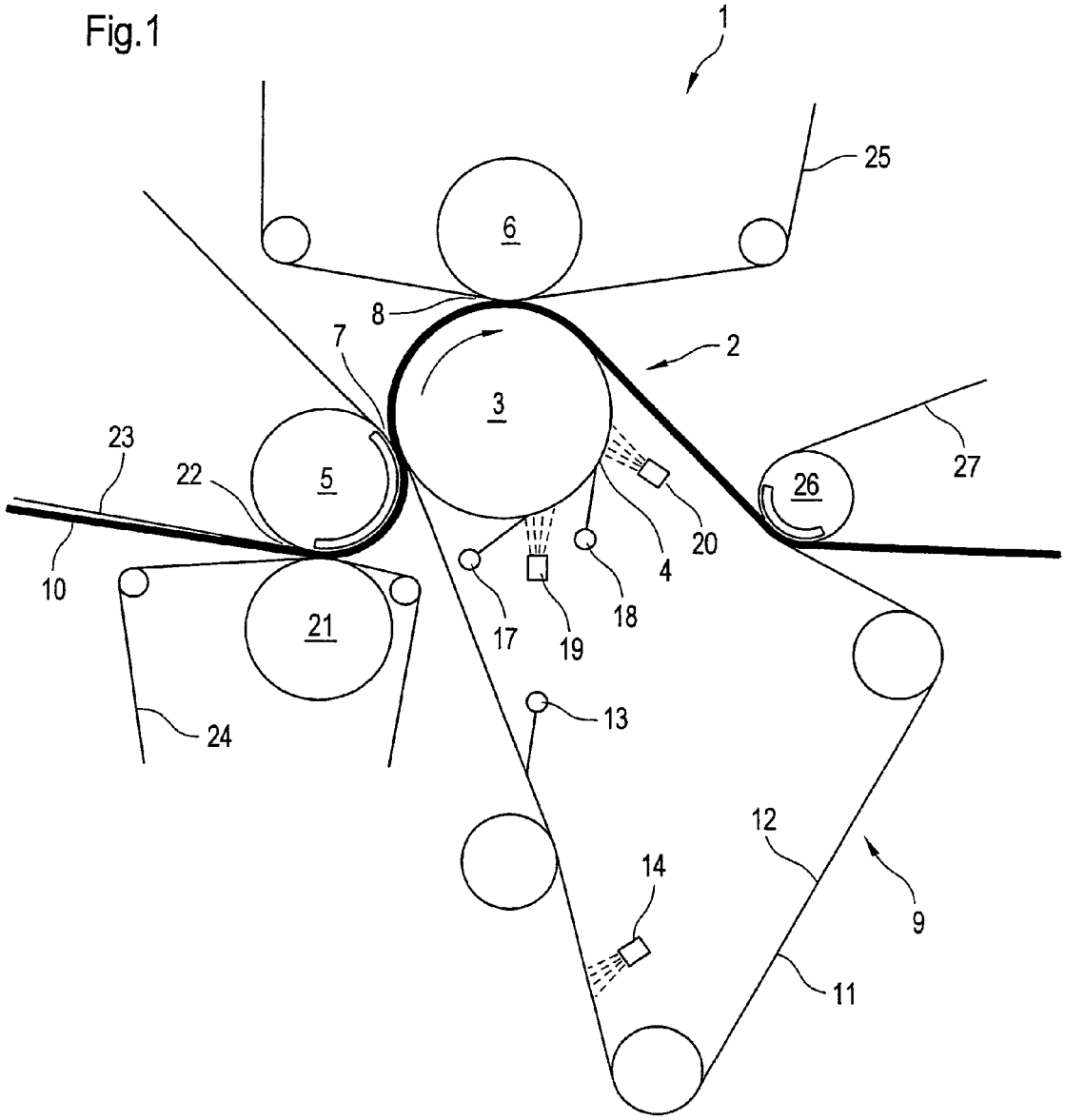
FIG. 1 shows a machine according to the invention with a central roller press.

FIG. 1 shows a machine 1 according to the invention with a central roller press 2. The central roller press 2 comprises a roller 3, also referred to as a central roller 3. The central roller 3 has a smooth circumferential surface 4.

Assigned to the central roller 3 are two opposing rollers 5 and 6, each of which forms a press nip 7 and 8 with the central roller 3. Furthermore, the central roller 3 is enwrapped by a transfer belt 9 in sections such that the transfer belt 9 is guided through the two press nips 7 and 8.

The transfer belt 9 has a top side 11, which can be brought into contact with a fibrous web 10, and a bottom side 12, which is in contact with the circumferential surface 4 of the roller 3 in the entire wrap zone.

The fibrous web 10 and the transfer belt 9 are guided together through the two press nips 7 and 8, whereby the transfer belt 9 is in contact with the roller 3.

In one embodiment, a surface structure of the bottom side 12 provides a storage capacity which is suitable for accommodating at least in part the water and/or air which gets into the wrap zone between the bottom side 12 and the circumferential surface 4.

Figure 2:
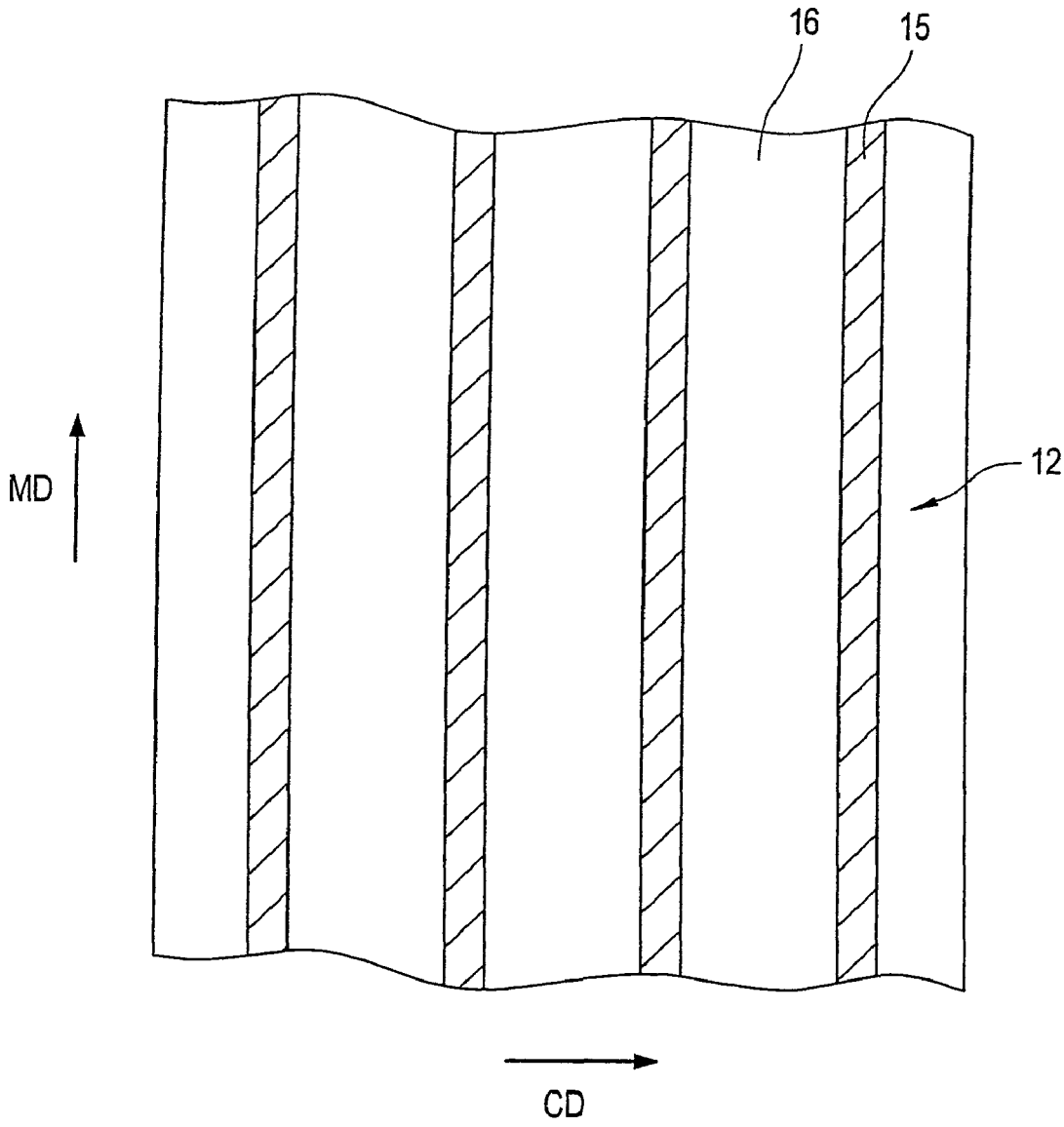
FIG. 2 shows a plan view of an endless belt according to the invention.

In the case of one embodiment, the bottom side 12 of the transfer belt 9 is formed by a polymer layer such as polyurethane for example, whereby the surface structure is formed by a groove arrangement with grooves 15, which form recesses in the bottom side 12, and with bars 16 arranged in between, which are created during production of the bottom side 12 by casting for example (see FIG. 2).

The grooves 15 extend in this case essentially longitudinally with respect to the running direction (MD direction) of the endless belt 9 such that fluid passing through a press nip can be led away from the press nip. Here the bottom side 12 is constructed such that the storage capacity is essentially maintained during compressive loading in a press nip.

The ratio of bar width to groove width is two, whereby the grooves have a width of 3 mm. A storage capacity of 400 milliliters per $m^2$ area of the bottom side 12 is provided by the surface structure of the bottom side 12.

Furthermore, the bottom side 12 of the endless belt 9 outside the wrap zone is assigned a doctor blade 13 for wiping off fluid and a spray tube 14 for cleaning the bottom side 12.

The doctor blade 13 is a soft plastic doctor blade without fiber reinforcement. The angle of incidence of the doctor blade 13 relative to the bottom side 12 is approx. 10°.

Furthermore, the circumferential surface 4 of the roller 3 outside the wrap zone is assigned doctor blades 17 and 18 for wiping off fluid and spray tubes 19 and 20 for cleaning the circumferential surface 4.

Before the fibrous web 10 runs through the central roller press 2, said web, positioned between two press felts 23 and 24, runs through a press nip 22 formed between the opposing roller 5 and another roller 21, whereby the press felt 23 is also guided through the press nip 7 formed between the central roller 2 and the opposing roller 5 such that upon passing through the press nip 7 the fibrous web 10 is in contact on its one side with the press felt 23 and on its other side with the transfer belt 9.

Furthermore, upon passing through the press nip 8 formed between the central roller 3 and the opposing roller 6 the fibrous web 10 is in contact on its one side with a press felt 25 and on its other wide with the transfer belt 9.

After the fibrous web 10 has passed through the central roller press 2, the fibrous web 2 is taken from the transfer belt 9 by means of an evacuated pick-up roller 26 and transferred to a skin 27.

Figure 3:
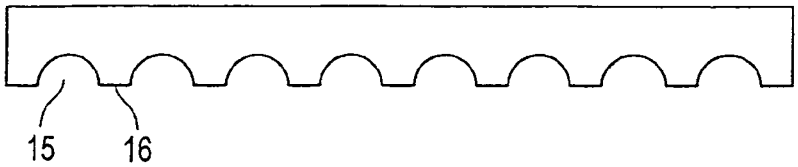
FIGS. 3*a-c* show in cross section various versions of groove arrangements for endless belts according to the invention or roller casings.
Figure 3:
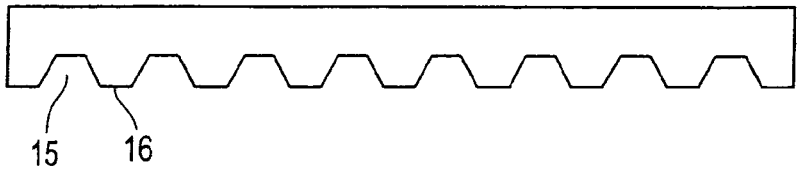
Figure 3:
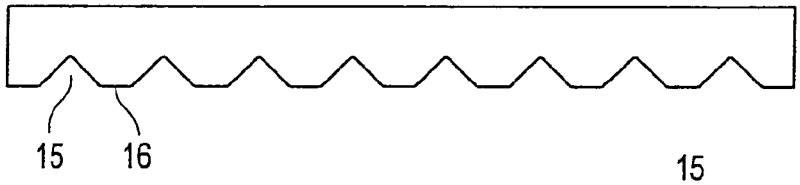

FIG. 3 shows in cross section various versions of groove arrangements for endless belts according to the invention or roller casings.

In the representation shown in FIG. 3*a* the grooves 15 have a semi-circular cross section.

In the representation shown in FIG. 3*b* the grooves 15 have a trapezoidal cross section. In the representation shown in FIG. 3*c* the grooves 15 have a triangular cross section.

Figure 4:
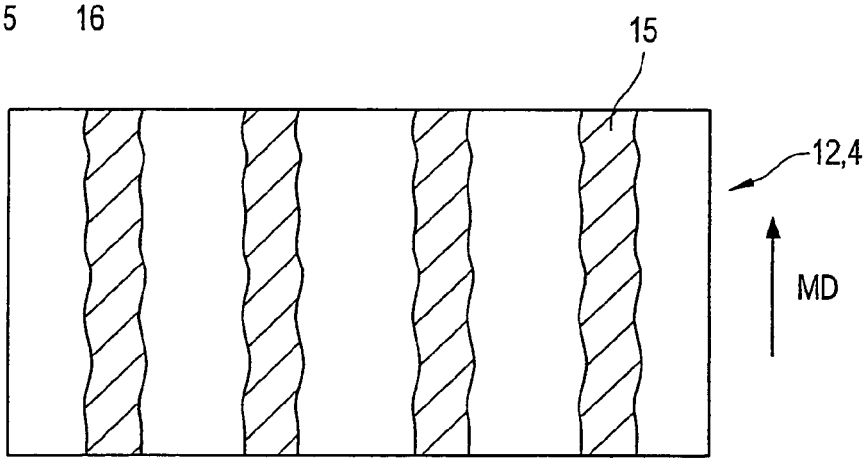
FIGS. 4*a-c* show a plan view of the bottom side or circumferential surface of various versions of surface structures for endless belts according to the invention or roller casings respectively.
Figure 4:
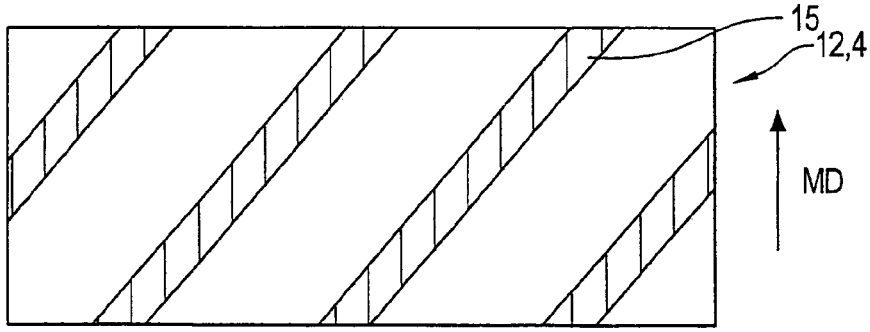
Figure 4:
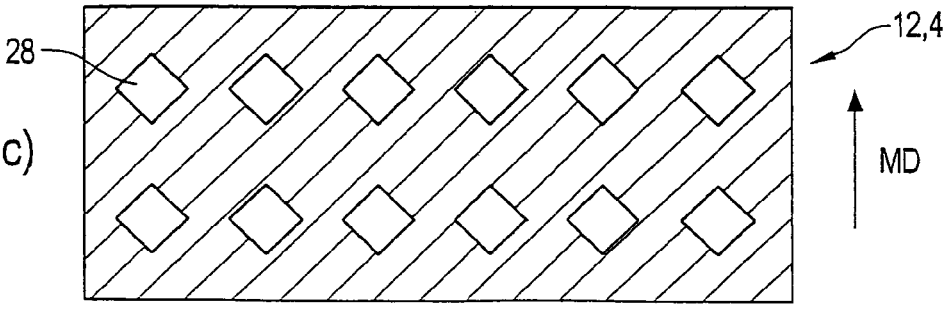

FIG. 4 shows a plan view of the bottom side 12 or circumferential surface 4 of various versions of surface structures for endless belts according to the invention or roller casings respectively.

In the representation shown in FIG. 4*a* the surface structure has irregularly constructed and recess-forming grooves 15.

In the representation shown in FIG. 4*b* the surface structure has recess-forming grooves 15 extending diagonally with respect to the running direction (MD direction).

In the representation shown in FIG. 4*c* the surface structure has lozenge-shaped elevations 28.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An endless belt for a machine for the production of a fiber material web having a top side and, arranged opposite thereto, a bottom side such that when the endless belt is used as intended the top side can be brought into contact with the fiber material web and the bottom side with the machine, said endless belt having a storage capacity for accommodating fluid acting on the bottom side_wherein the storage capacity is provided substantially by the surface structure of the bottom side and the bottom side is formed by an impermeable polymer layer, in which case the surface structure is created at least one of during production of the polymer layer and after production of the polymer layer and wherein the storage capacity is provided at least in part by an at least partly porous structure of the endless belt.

2. An endless belt according to claim 1, wherein the bottom side is constructed such that the storage capacity is essentially maintained during compressive loading in a press nip.

3. An endless belt according to claim 1, wherein the bottom side is constructed such that fluid passing through a press nip is led away from the press nip.

4. An endless belt according to claim 1, wherein the endless belt has a storage capacity which changes transversely with respect to the running direction.

5. An endless belt according to claim 1, wherein the surface structure comprises a bar and groove arrangement.

6. An endless belt according to claim 5, wherein the groove arrangement extends essentially longitudinally with respect to the running direction of the endless belt.

7. An endless belt according to claim 5, wherein the ratio of bar width to groove width is between 0.5 and 10.

8. An endless belt according to claim 5, wherein the grooves have a width of between 0.2 and 10 mm.

9. An endless belt according to claim 5, wherein the grooves have a width of between 1 and 5 mm.

10. An endless belt according to claim 5, wherein the depth of the grooves is less than 50% of the overall thickness of the endless belt.

11. An endless belt according to claim 5, wherein the distance and/or the cross-sectional area and/or the shape of at least two adjacent grooves are different.

12. An endless belt according to claim 1, wherein the surface structure is created during production of the polymer layer by casting or molding.

13. An endless belt according to claim 1, wherein the surface structure is created after production of the polymer layer by at least one of mechanical and thermal and chemical processing.

14. An endless belt according to claim 1, wherein the porous structure comprises at least one of fleece and fabric and a foamed structure.

15. An endless belt according to claim 1, wherein the storage capacity is between 5 and 1000 milliliters per $m^2$ area of the bottom side.

16. An endless belt according to claim 1, wherein the storage capacity is between 50 and 500 milliliters per $m^2$ area of the bottom side.

17. An endless belt for a machine for the production of a fiber material web having a top side and, arranged opposite thereto, a bottom side such that when the endless belt is used as intended the top side can be brought into contact with the fiber material web and the bottom side with the machine, said endless belt having a storage capacity for accommodating fluid acting on the bottom side wherein the storage capacity is provided substantially by the surface structure of the bottom side and the bottom side is formed by an impermeable polymer layer, in which case the surface structure is created at least one of during production of the polymer layer and after production of the polymer layer, wherein the surface structure of the bottom side has a roughness Ra of 3 to 40 μm.

* * * * *